US009103208B2

(12) United States Patent
Macintyre et al.

(10) Patent No.: US 9,103,208 B2
(45) Date of Patent: Aug. 11, 2015

(54) CUTTING BIT WITH HARD CUTTING TIP CENTERING AND BRAZE JOINT CONTROL FEATURE

(75) Inventors: Ray C. Macintyre, Alum Bank, PA (US); William P. Prezlock, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 525 days.

(21) Appl. No.: 13/494,425

(22) Filed: Jun. 12, 2012

(65) Prior Publication Data

US 2013/0327577 A1 Dec. 12, 2013

(51) Int. Cl.

| | |
|---|---|
| ***E21C 35/18*** | (2006.01) |
| ***E21C 35/183*** | (2006.01) |
| ***E21B 10/573*** | (2006.01) |

(52) U.S. Cl.

CPC ..... *E21C 35/183* (2013.01); *E21C 35/18* (2013.01); *E21B 10/573* (2013.01)

(58) Field of Classification Search

CPC ..... E21C 35/183; E21C 35/18

USPC ..... 299/111, 113; 175/420.1, 431, 435, 175/413, 428

See application file for complete search history.

(56) References Cited

U.S. PATENT DOCUMENTS

| | | | | |
|---|---|---|---|---|
| 2,022,194 | A * | 11/1935 | Galvin | 175/382 |
| 4,817,742 | A | 4/1989 | Whysong | |
| 4,817,743 | A | 4/1989 | Greenfield et al. | |
| 4,821,819 | A | 4/1989 | Whysong | |
| 2005/0098359 | A1 * | 5/2005 | Lee | 175/432 |
| 2012/0080931 | A1 * | 4/2012 | Wang | 299/113 |

* cited by examiner

*Primary Examiner* — Giovanna C Wright
(74) *Attorney, Agent, or Firm* — Matthew W. Gordon

(57) ABSTRACT

A cutting bit includes an elongate body having a shank portion and a head portion with an axial forward end. The head portion defines a pocket at the axial forward end thereof. The pocket includes a bottom surface and a sidewall extending from the bottom surface, wherein the sidewall of the pocket includes a plurality of projections extending outwardly from the sidewall. The cutting bit also includes a hard cutting tip attachably received in the pocket of the head portion. The plurality of projections are structured and arranged to position the hard cutting tip in the pocket and facilitate formation of a braze joint between the hard cutting tip and the pocket of the head portion.

7 Claims, 6 Drawing Sheets

CUTTING BIT WITH HARD CUTTING TIP CENTERING AND BRAZE JOINT CONTROL FEATURE

BACKGROUND OF THE INVENTION

The present invention generally relates to mining and construction tools, and more particularly relates to cutting bits with hard cutting tip centering and braze joint control features.

Cutting bits are used in various road milling, mining and excavating operations. The cutting bits are mounted on a support structure such as a rotary drum. Each cutting bit typically has a hard, wear resistant cutting tip made of a material such as tungsten carbide that is attached to a generally conical steel head portion of the cutting bit.

The hard cutting tip is typically brazed into a notch or pocket formed in the head portion of the cutting bit using a braze alloy so that a braze joint is formed between the hard cutting tip and the cutting bit body, i.e. the head portion. Throughout the course of the cutting operation, the braze joint experiences severe stresses due to the continual intermittent violent impingement of the cutting bit against the particular substrate material. Over the course of time, the braze joint can experience sufficient stress so as to fail thereby allowing the hard cutting tip to separate from the cutting bit body. Obviously, if the cutting bit loses the hard cutting tip, the cutting bit is no longer useful for the cutting operation.

It is, therefore, important that the braze joint provide a uniform and consistent attachment between the hard cutting tip and the cutting bit body, as well as, provide a strong and reliable connection therebetween so as to prevent the hard cutting tip from separating from the cutting bit body.

Thus, it can be appreciated that it would be highly desirable to provide an improved cutting bit that overcomes disadvantages, shortcomings and limitations of known tools. It can also be appreciated that it would be highly desirable to provide an improved cutting bit with an improved braze joint that overcomes disadvantages, shortcomings and limitations of known tools.

SUMMARY OF THE INVENTION

In accordance with an aspect of the invention, a cutting bit includes an elongate body having a shank portion and a head portion with an axial forward end. The head portion defines a pocket at the axial forward end thereof. The pocket includes a bottom surface and a sidewall extending from the bottom surface, wherein the sidewall of the pocket includes a plurality of projections extending outwardly from the sidewall. The cutting bit also includes a hard cutting tip attachably received in the pocket of the head portion. The plurality of projections are structured and arranged to position the hard cutting tip in the pocket and facilitate formation of a braze joint between the hard cutting tip and the pocket of the head portion.

In accordance with another aspect of the invention, a cutting bit includes an elongate body having a shank portion and a head portion with an axial forward end. The head portion defines a pocket at the axial forward end thereof. The pocket includes a bottom surface and a sidewall extending from the bottom surface, wherein the sidewall of the pocket includes at least two projections extending outwardly from the sidewall. The cutting bit also includes a hard cutting tip attachably received in the pocket of the head portion. The at least two projections are structured and arranged to position the hard cutting tip in the pocket and facilitate formation of a braze joint between the hard cutting tip and the pocket of the head portion.

In accordance with an additional aspect of the invention, a cutting bit includes an elongate body having a shank portion and a head portion with an axial forward end. The head portion defines a pocket at the axial forward end thereof. A plurality of projections each extend outwardly from a sidewall of the pocket. The cutting bit also includes a hard cutting tip attachably received in the pocket of the head portion. The plurality of projections are structured and arranged to position the hard cutting tip in the pocket.

These and other aspects of the present invention will be more fully understood following a review of this specification and drawings.

DETAILED DESCRIPTION

Figure 1:
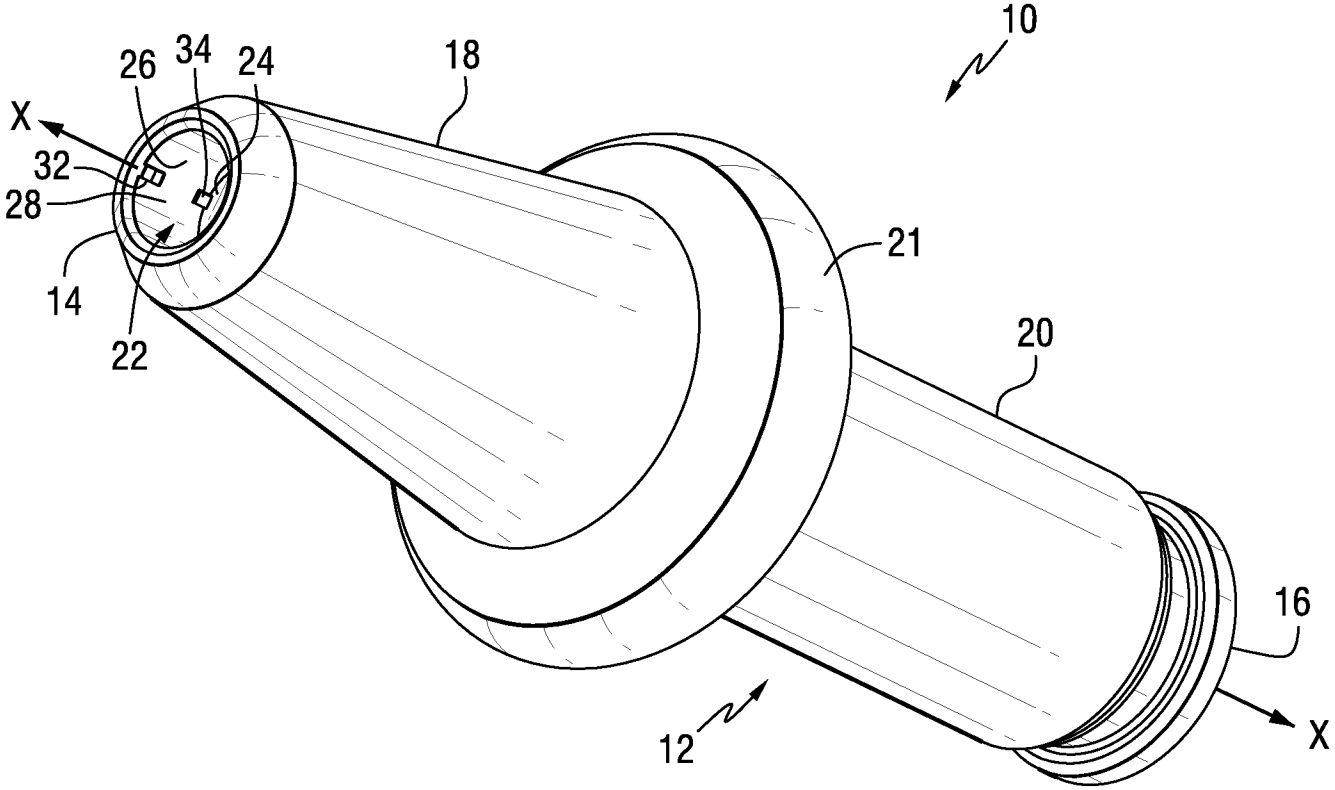
FIG. 1 is an isometric view of a cutting bit, in accordance with an aspect of the invention.
Figure 2:
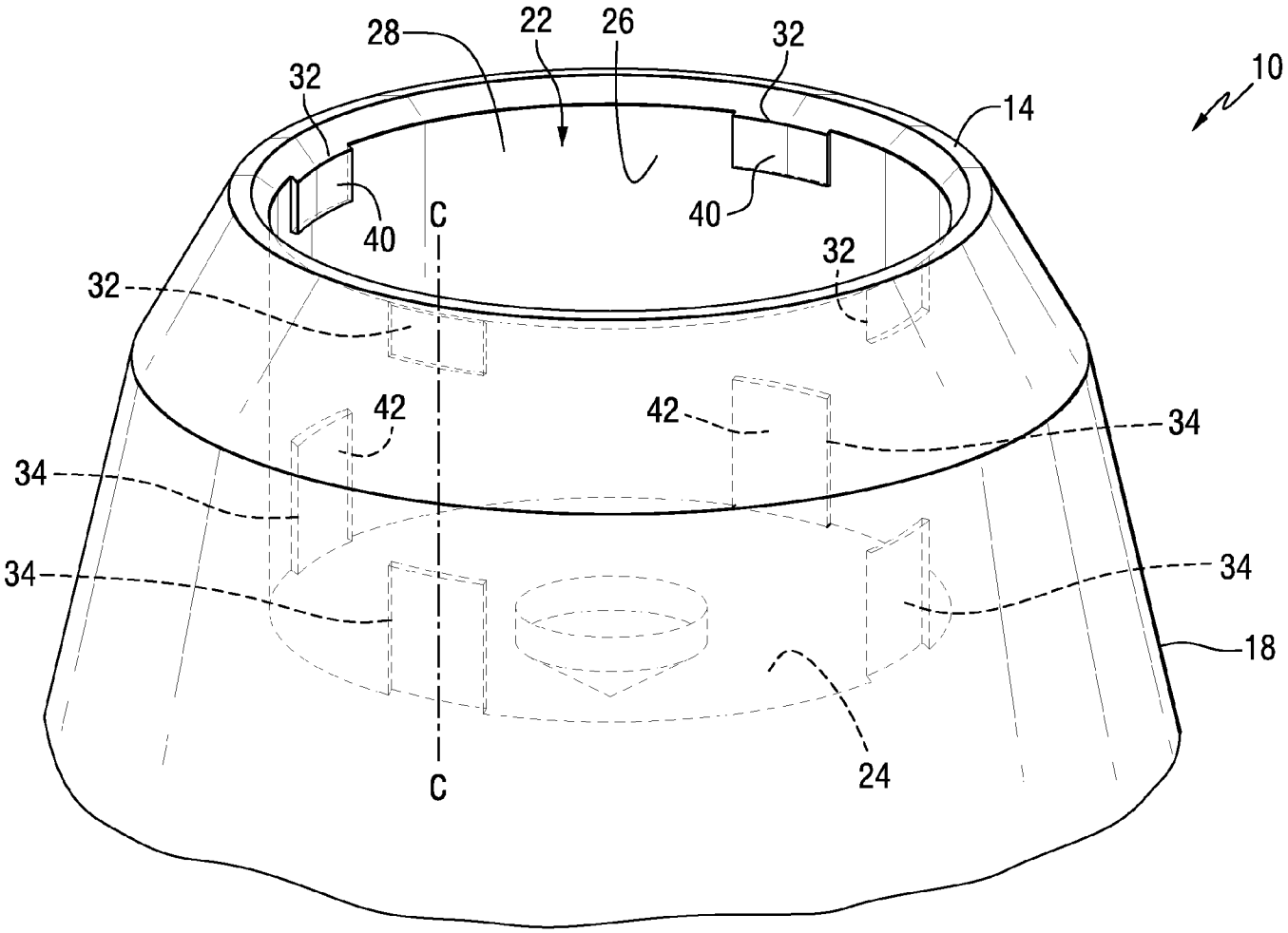
FIG. 2 is a partial view of a head portion of the cutting bit illustrated in FIG. 1, in accordance with an aspect of the invention.
Figure 3:
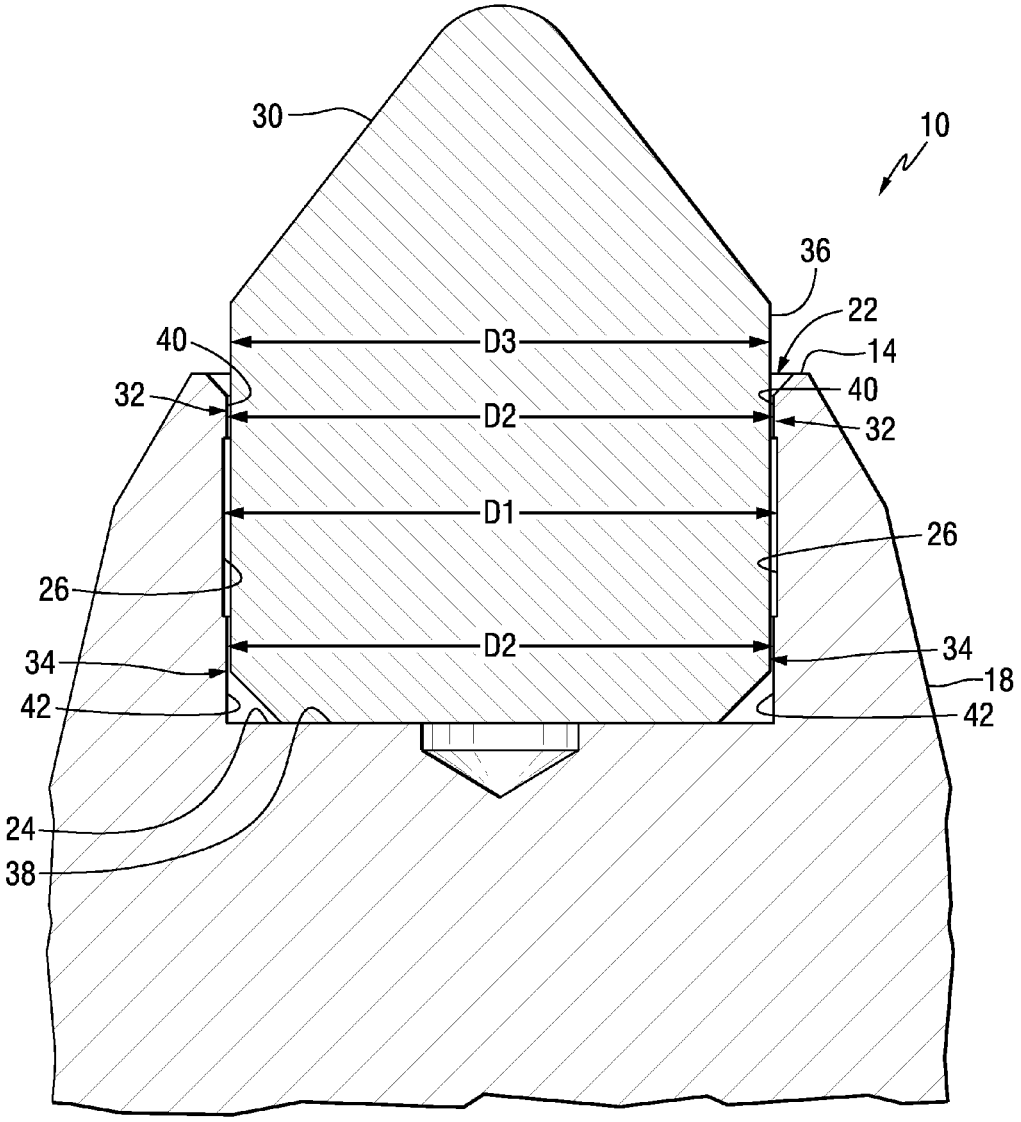
FIG. 3 is a partial sectional view of a head portion of the cutting bit illustrated in FIG. 1 with a hard cutting tip inserted therein, in accordance with an aspect of the invention.

Referring to FIGS. 1, 2 and 3, there is illustrated a cutting bit, generally designated as reference number 10, in accordance with aspects of the invention. It will be appreciated that the invention has application to various kinds of cutting tools useful in various kinds of cutting operations. Exemplary operations include, without limitation, road planing (or milling), coal mining, concrete cutting, and other kinds of cutting operations wherein a cutting bit with a hard cutting member impinges against a substrate (e.g., earth strata, pavement, asphaltic highway material, concrete, and the like) breaking the substrate into pieces of a variety of sizes including larger-size pieces or chunks and smaller-sized pieces including dust-like particles. In addition, it will be appreciated that the cutting bit 10 of the invention may be manufactured in various sizes and dimensions depending upon the desired application of the tool.

Cutting bit 10 has a central longitudinal axis X-X. Cutting bit 10 includes an elongate cutting tool body, generally designated as 12, which typically is made of, for example, steel. Elongate body 12 has an axial forward end 14 and an axial rearward end 16.

Elongate body 12 further includes a head portion 18 adjacent the axial forward end 14 and a shank portion 20 adjacent the axial rearward end 16. The shank portion 20 may be provided with various shapes and configurations. In one aspect, the shank portion 20 may be structured and arranged to be rotatable such that the cutting bit 10 is a rotatable type cutting tool. The tool body 12 may also include a collar portion 21.

The head portion 18 defines a pocket 22 at or adjacent to the axial forward end 14 of the tool body 12. The pocket 22 includes a bottom surface 24 and a sidewall 26 extending from the bottom surface 24. In one aspect, the sidewall 26 is continuous and has a generally circular shape. The sidewall 26 defines a pocket opening 28 at or adjacent to the axial forward end 14 of the tool body 12. The pocket opening 28 is generally opposite to or opposing to the bottom surface 24. In one aspect, the pocket 22 has a generally cylindrical shape.

The pocket 22 of the head portion 18 is structured and arranged to receive a hard cutting tip 30 (see, for example, FIG. 3). The hard cutting tip 30, which may be made of, for example, a tungsten carbide material or other appropriate hard materials used for such cutting bits, may be attached or affixed by, for example, brazing the hard cutting tip 30 to the pocket 22 of the head portion 18, as will be described in more detail herein.

Still referring to FIGS. 1, 2 and 3, the pocket 22 further includes a plurality of projections 32 and 34 which extend generally outwardly from the sidewall 26 of the pocket 22. In other words, the projections 32 and 34 extend or project from the sidewall 26 and into the space defined by the pocket 22. In one aspect, the plurality of projections 32 and 34 are structured and arranged to orient or position the hard cutting tip 30 in the pocket 22 and aid or facilitate in the formation of a braze joint between the hard cutting tip 30 and the pocket 22 of the head portion 18. More specifically, to facilitate in the formation of a braze joint between, for example, an annular outer sidewall 36 and bottom 38 of the hard cutting tip 30 and the sidewall 26 and the bottom surface 24 of the pocket 22.

In an aspect of the invention, the projections 32 comprise a first group of projections that are formed or positioned at or adjacent to the pocket opening 28. In addition, the projections 34 comprise a second group of projections that are formed or positioned at or adjacent to the bottom surface 24 of the pocket 22. In one aspect, the projections 32 are spaced apart from the projections 34. It will be appreciated, however, that the projections 32 and/or 34 may be formed or positioned at various other locations on the sidewall 26 within the pocket 22.

In another aspect of the invention, each of the projections 32, e.g. the first group of projections, are generally axially aligned with each of the corresponding projections 34, e.g. the second group of projections, as illustrated by, for example, centerline C shown in FIG. 2. However, it will be appreciated that the projections 32 may be formed or positioned to not be axially aligned with the projections 34, e.g. the projections 32 may be offset axially from the projections 34.

In one aspect, the projections 32 and 34 have various sizes, shapes and configurations. For example, as illustrated in FIG. 2, the projections 32 are generally smaller in surface area than the projections 34, but could be formed to have different size relations in accordance with aspects of the invention. Also for example, as illustrated in FIG. 2, the projections 32 and/or the projections 34 may have generally rectangular shapes, but could be formed to have different shapes such as, for example, square, in accordance with aspects of the invention.

In another aspect of the invention, the plurality of projections 32 and/or 34 may be equally spaced circumferentially about the sidewall 26 of the pocket 22. In one example, FIG. 2 illustrates four projections 32 spaced equally around the sidewall 26 and four projections 34 spaced equally around the sidewall 26. The four projections 32 and the four projections 34 are spaced about 90 degrees apart as measured, for example, from the centerline C of each projection. It will be appreciated that an additional number of projections 32 and/or 34 may be used in accordance with the invention.

Figure 2A:
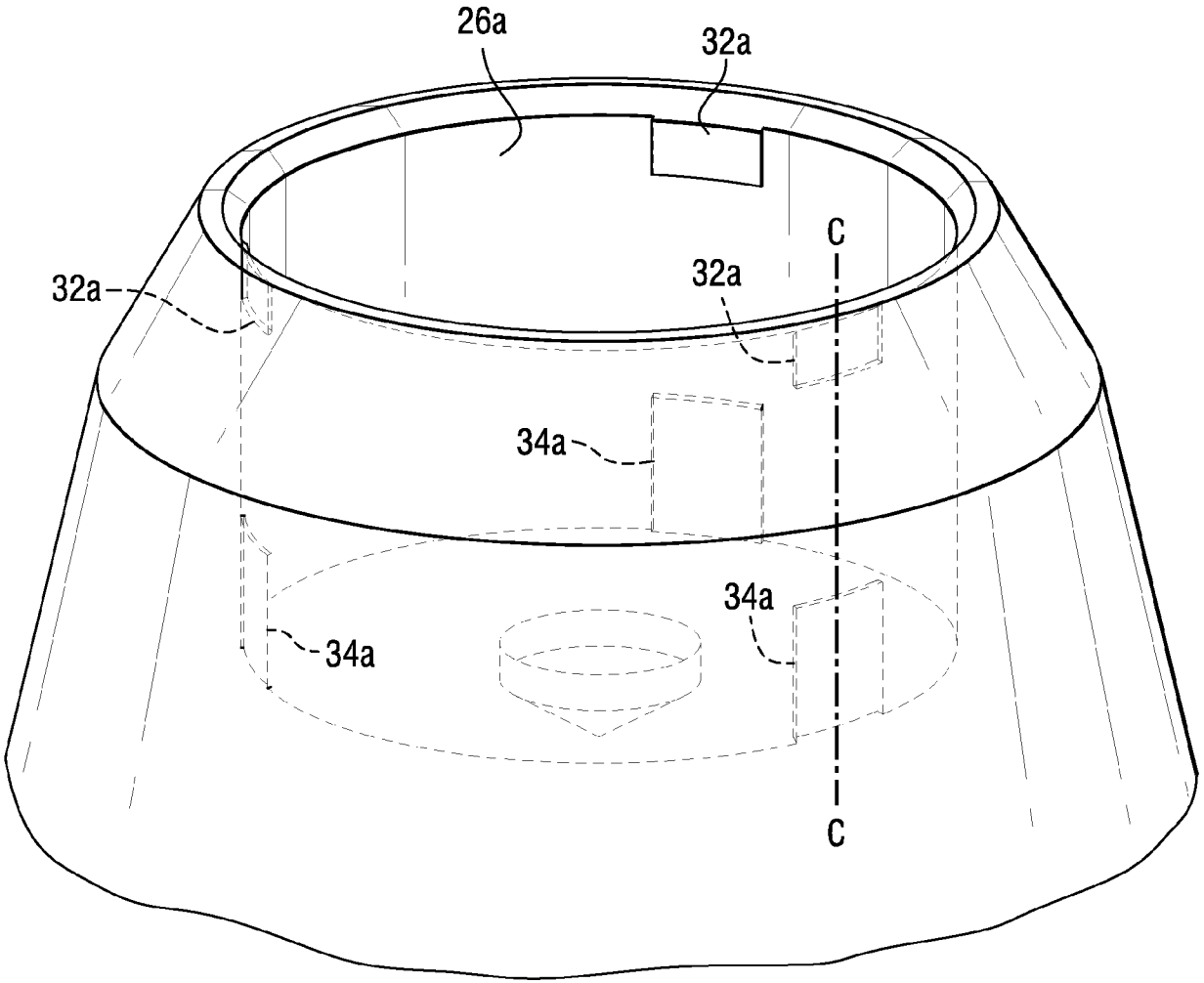
FIG. 2A is a partial view of an additional head portion similar to FIG. 2, in accordance with an additional aspect of the invention.

In another example, FIG. 2A illustrates three projections 32*a* spaced equally around sidewall 26*a* and three projections 34*a* spaced equally around the sidewall 26*a*. The three projections 32*a* and the three projections 34*a* are spaced about 120 degrees apart as measured, for example, from the centerline C of each projection.

Figure 2B:
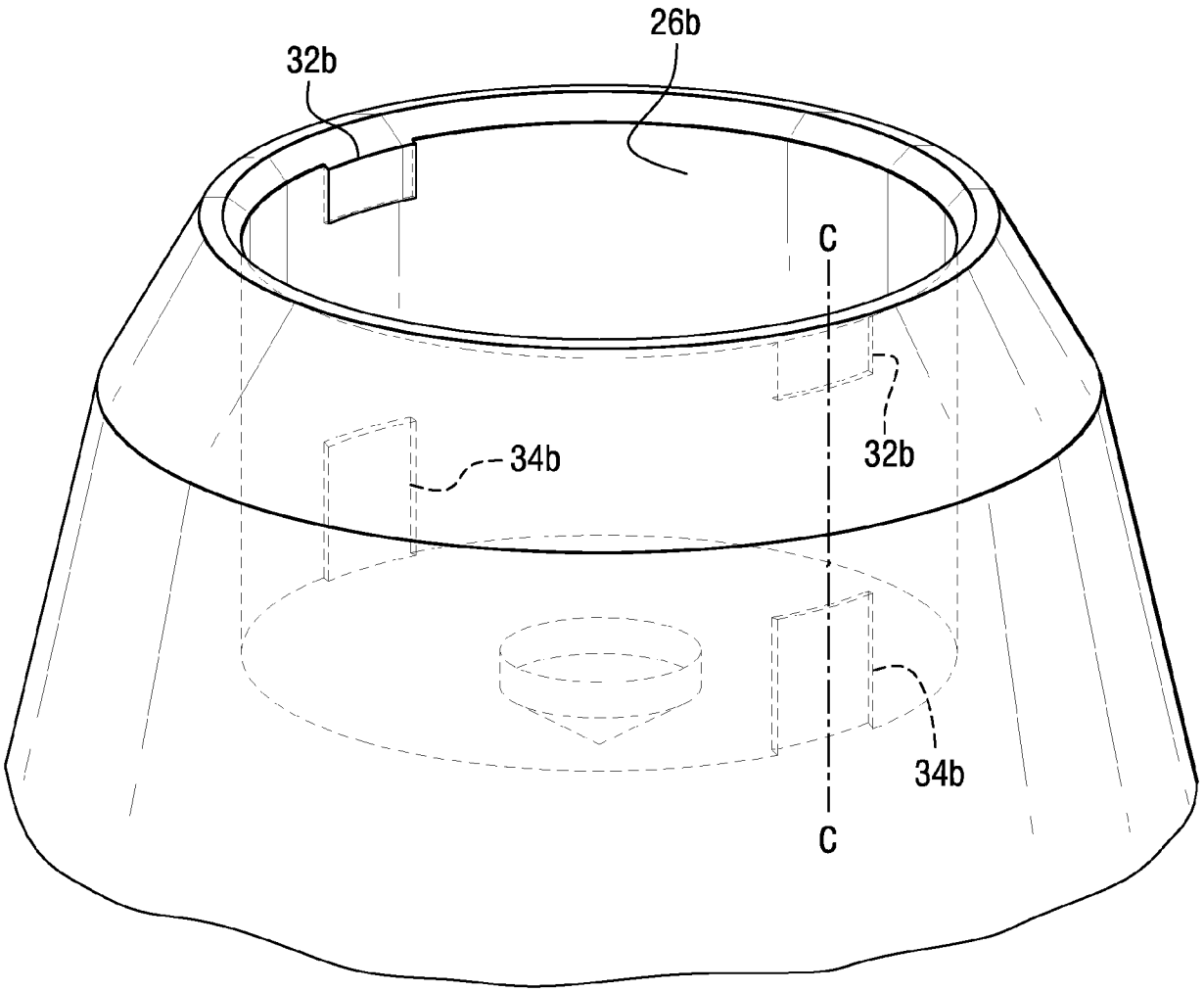
FIG. 2B is a partial view of yet an additional head portion similar to FIGS. 2 and 2A, in accordance with yet an additional aspect of the invention.

In another example, FIG. 2B illustrates two projections 32*b* spaced equally around sidewall 26*b* and two projections 34*b* spaced equally around the sidewall 26*b*. The two projections 32*b* and the two projections 34*b* are spaced about 180 degrees apart as measured, for example, from the centerline C of each projection.

Referring to FIG. 3, the pocket 22 of the head portion 18 has a first diameter D1, e.g. measured from a point on sidewall 26 to an opposing point on sidewall 26. Each of the plurality of projections 32 includes an outward face 40 and each of the plurality of projections 34 includes an outward face 42. Opposing outward faces 40 and opposing outward faces 42 each define a second diameter D2, e.g. measured from a point on an outward face 40 to an opposing point on an outward face 40 and similarly measured from a point on an outward face 42 to an opposing point on an outward face 42 (or measured as a diameter of a circle containing the outward faces 40 and/or outward faces 42). In one aspect, the first diameter D1 is greater than the second diameter D2, i.e. D2 is less than D1.

Still referring to FIG. 3, the hard cutting tip 30 defines a third diameter D3. In one aspect, the second diameter D2 is greater than the third diameter D3, i.e. D3 is less than D2, which also means that D3 is less than D1.

During assembly of the cutting bit 10, the hard cutting tip 30 is placed in the pocket 22 of the head portion 18. As described, the plurality of projections 32 and 34 are structured and arranged to orient or position the hard cutting tip 30 in the pocket 22 and facilitate in the formation of a braze joint between the hard cutting tip 30 and the pocket 22 of the head portion 18. More specifically, the plurality of projections 32 and 34 are structured and arranged to orient or position the hard cutting tip 30 in the pocket 22 to facilitate in the formation of a braze joint between, for example, the annular outer sidewall 36 and bottom 38 of the hard cutting tip 30 and the sidewall 26 and the bottom surface 24 of the pocket 22.

In one aspect of the invention, the plurality of projections 32 and 34 are structured and arranged to generally center the hard cutting tip 30 in the pocket 22 and facilitate in the formation of a braze joint between the hard cutting tip 30 and the pocket 22 of the head portion 18. During the brazing operation the brazing alloy is placed in a solid form in close proximity to the components being brazed. When the alloy and the components reach the braze melt flow temperature it disperses throughout the joint area by capillary action bonding the components together. Capillary action is affected by the amount of clearance between the components and is important in creating good quality braze joints. The projections 32 and 34 keep the hard cutting tip 30 from moving against the sidewall 26 of the pocket 22. If large areas of the components contact each other braze will not flow through. On the opposite side due to the large gap capillary action is impaired and voids can be created causing a weak braze joint. These voids and areas where no or minimal braze is attached to the components can cause premature failure of the cutting tip 30.

Figure 4A:
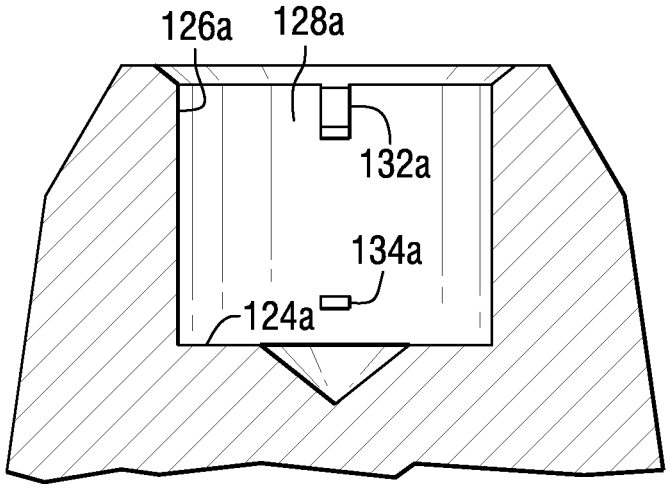
FIG. 4A is a partial sectional view of another head portion of a cutting bit, in accordance with an aspect of the invention.
Figure 4B:
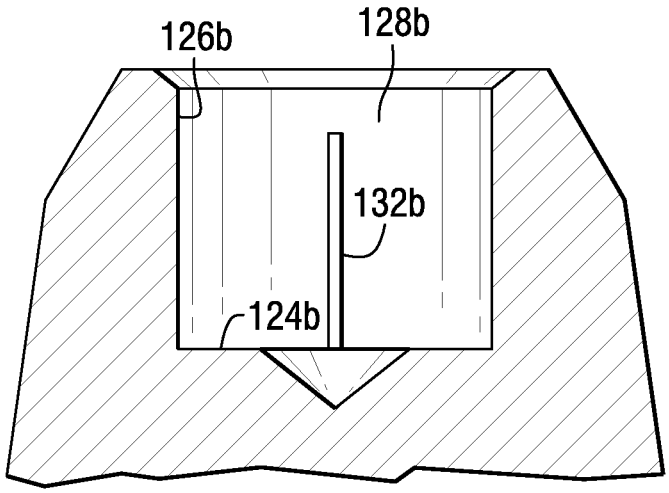
FIG. 4B is a partial sectional view of yet another head portion of a cutting bit, in accordance with another aspect of the invention.
Figure 4C:
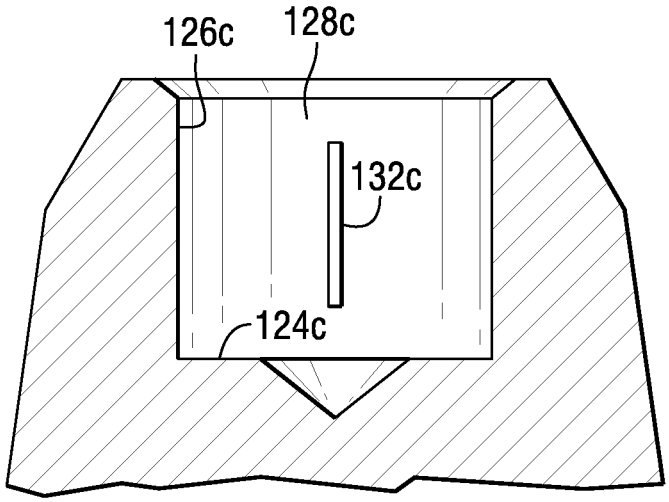
FIG. 4C is a partial sectional view of an additional head portion of a cutting bit, in accordance with an additional aspect of the invention.

FIGS. 4A, 4B and 4C illustrate other projection arrangements and configurations, in accordance with aspects of the invention. For example, FIG. 4A illustrates projections 132*a* formed adjacent pocket opening 128*a* and projections 134*a* formed on sidewall 126*a* but spaced apart from bottom surface 124*a*. In another example, FIG. 4B illustrates an elongated projection 132*b* formed on sidewall 126*b* and extending from adjacent bottom surface 124*b*. In yet another example, FIG. 4C illustrates an elongated projection 132*c* formed on sidewall 126*c* but spaced from bottom surface 124*c* and pocket opening 128*c*. In each of the examples shown in 4A, 4B and 4C, it will be appreciated that additional projections 132*a*, 134*a*, 132*b* and 132*c* would be provided around the respective sidewalls 126*a*, 126*b* and 126*c*, in accordance with aspects of the invention as described herein. In addition, it will be appreciated that other projection arrangements and configurations may be provided, in accordance with aspects of the invention.

The projections, e.g. projections 32 and 34, may be formed during manufacturing by, for example, cold forming the pocket 22 and projections 32 and 34 into the axial forward end 14 of the head portion 18, e.g. in the cutting bit tool body nose portions, at the same time other part features are progressively being formed. The projections 32 and 34 can also be formed by, for example, taking a cutting bit body and predrilling a hole in the axial forward end14 and then pressing a formed punch into the pocket 22 as a secondary operation and upsetting portions of the pocket side walls 26 and bottom material around the punch form creating the projection features 32 and 34.

Whereas particular aspects of this invention have been described above for purposes of illustration, it will be evident to those skilled in the art that numerous variations of the details of the present invention may be made without departing from the invention as defined in the appended claims.

What is claimed is:

1. A cutting bit, comprising:

an elongate body having a shank portion and a head portion with an axial forward end, wherein the head portion defines a pocket at the axial forward end of the head portion, the pocket including a bottom surface and a sidewall extending from the bottom surface, wherein the sidewall of the pocket includes a plurality of projections extending outwardly from the sidewall; and a hard cutting tip attachably received in the pocket of the head portion, wherein the plurality of projections are structured and arranged to position the hard cutting tip in the pocket and facilitate formation of a braze joint between the hard cutting tip and the pocket of the head portion, wherein the pocket includes a pocket opening defined by the sidewall, the pocket opening being generally opposed to the bottom surface of the pocket, wherein the plurality of projections includes a first group of projections that are formed adjacent the pocket opening, and wherein the plurality of projections includes a second group of projections that are formed adjacent the bottom surface of the pocket.

2. The cutting bit of claim 1, wherein the plurality of projections are structured and arranged to generally center the hard cutting tip in the pocket.

3. The cutting bit of claim 1, wherein the sidewall of the pocket is generally circular and the plurality of projections are each equally spaced circumferentially about the sidewall of the pocket.

4. The cutting bit of claim 1, wherein the first group of projections are aligned with the second group of projections.

5. The cutting bit of claim 1, wherein the first group of projections are spaced apart from the second group of projections.

6. The cutting bit of claim 1, wherein the pocket defines a first diameter and each of the plurality of projections include an outward face that defines a second diameter that is less than the first diameter of the pocket.

7. The cutting bit of claim 6, wherein the hard cutting tip defines a third diameter that is less than the second diameter of the outward faces of the plurality of projections.

* * * * *